US009081336B2

(12) United States Patent
Matsuo et al.

(10) Patent No.: US 9,081,336 B2
(45) Date of Patent: Jul. 14, 2015

(54) IMAGE FORMING APPARATUS

(71) Applicant: CANON KABUSHIKI KAISHA, Tokyo (JP)

(72) Inventors: Takamichi Matsuo, Suntou-gun (JP); Hiroshi Kawaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 69 days.

(21) Appl. No.: 14/069,721

(22) Filed: Nov. 1, 2013

(65) Prior Publication Data

US 2014/0169850 A1 Jun. 19, 2014

(30) Foreign Application Priority Data

Dec. 14, 2012 (JP) ..... 2012-273754

(51) Int. Cl.
*G03G 15/20* (2006.01)
*G03G 15/00* (2006.01)

(52) U.S. Cl.
CPC ..... *G03G 15/2021* (2013.01); *G03G 15/2039* (2013.01); *G03G 15/6573* (2013.01)

(58) Field of Classification Search
CPC ..... G03G 15/2014; G03G 21/206; G03G 15/6573; G03G 2221/1645; G03G 2115/00805
USPC ..... 399/341, 33, 44, 69, 94; 430/124.1
See application file for complete search history.

(56) References Cited

U.S. PATENT DOCUMENTS

| | | | | |
|---|---|---|---|---|
| 2005/0196204 | A1* | 9/2005 | Funato et al. | 399/341 |
| 2010/0080634 | A1* | 4/2010 | Kimura | 399/329 |
| 2011/0103808 | A1 | 5/2011 | Abe et al. | |
| 2011/0103809 | A1 | 5/2011 | Kuwata et al. | |

FOREIGN PATENT DOCUMENTS

| | | |
|---|---|---|
| JP | 2003-21978 A | 1/2003 |
| JP | 2006-3404 A | 1/2006 |

* cited by examiner

*Primary Examiner* — Rochelle-Ann J Blackman
(74) *Attorney, Agent, or Firm* — Fitzpatrick, Cella, Harper & Scinto

(57) ABSTRACT

An image forming apparatus includes process cartridges forming a toner image on a sheet by using a toner containing a parting agent, an exposure device, an intermediate transfer belt, primary transfer rollers, secondary transfer rollers, a fixing roller and a pressing rotating member which fix the toner image formed on the sheet, a blower fan configured to adjust the temperature of the sheet on which the toner image is fixed, a pair of discharge rollers which conveys the sheet, the temperature of which is adjusted, and a controller which controls the blower fan such that the temperature of the sheet S after contact with the pair of discharge rollers rises to a melting point of the parting agent or higher, or the temperature of the sheet S before contact with the pair of discharge rollers falls to below the melting point of the parting agent.

23 Claims, 13 Drawing Sheets

IMAGE FORMING APPARATUS

BACKGROUND OF THE INVENTION

1. Field of the Invention

The present invention relates to an electrophotographic image forming apparatus, and more particularly, an image forming apparatus which heat-fixes a toner image formed on a sheet.

2. Description of the Related Art

In the past, an electrophotographic image forming apparatus transfers a toner image to a sheet, the toner image being formed on an image bearing member such as a photosensitive drum or an intermediate transfer belt, melts the toner image by heating and pressurizing the sheet, and fixes the toner image on the sheet. Also, in the case of forming a color image, four toners of yellow, cyan, magenta, and black are transferred to a sheet in a superimposing manner and melts the superimposed transferred toner image by heating and pressurizing the sheet to fix the toner image on the sheet.

At this time, a color image used in a photograph or the like requires higher color developing property and gloss property. Therefore, color toners of yellow, cyan, and magenta are required to be more sharp-melted at a low temperature side. However, a toner having a high sharp-melt property tends to be vulnerable to hot offset. Hence, in a case where a color image used in a photograph or the like is formed on a sheet, a wax-containing toner is used for improving toner parting properties and preventing hot offset.

Generally, it is known that a gloss of an image varies depending on cooling states of a toner and a wax after fixing a wax-containing toner. Therefore, if a member such as a conveying roller is brought into contact with a toner image on a sheet where a thermally fixed wax is not solidified, a difference in the cooling state of the wax occurs between a contact portion and a non-contact portion, causing gloss unevenness (hereinafter, referred to as "roller mark").

In order to solve the problem of the occurrence of the roller mark, there is proposed an image forming apparatus which includes an air blowing hole between a fixing device and a conveying roller and solidifies a thermally fixed wax by blowing cooling air from the air blowing hole (see Japanese Patent Laid-Open No. 2003-21978).

Also, there is proposed an image forming apparatus configured such that a member such as a conveying roller is not brought into contact with a toner image until a temperature of a toner image is lower than a melting point of a wax (see Japanese Patent Laid-Open No. 2006-3404).

However, in the case of the image forming apparatus described in Japanese Patent Laid-Open No. 2003-21978, if a perimeter of a discharge portion side of the fixing device is warmed by a movement of a sheet or the like, a temperature of a fixed toner image rises, and thus, it may be difficult to cool down the temperature of the toner image to a melting point of a wax or lower before contact with the conveying roller. In this case, it is necessary to provide a more powerful cooling device or to perform cooling by reducing a sheet conveying speed. Also, the image forming apparatus described in Japanese Patent Laid-Open No. 2006-3404 has a problem in that since it takes time to perform cooling if a temperature of a toner image becomes high, a time for preventing the contact of the member such as the conveying roller is extended, leading to degraded productivity.

Therefore, it is desirable to provide an image forming apparatus which can prevent the occurrence of gloss unevenness, which is caused by a parting agent contained in a toner, through a simple structure, without degrading productivity.

SUMMARY OF THE INVENTION

The present invention provides an image processing apparatus including: a toner image forming unit which forms a toner image on a sheet by using a toner containing a parting agent; a fixing unit which fixes the toner image formed on the sheet; a sheet temperature adjusting unit which is capable of adjusting a temperature of the sheet on which the toner image is fixed; a pair of conveying rollers which conveys the sheet, the temperature of which is adjusted; and a controller which controls the sheet temperature adjusting unit such that the temperature of the sheet after contact with the pair of conveying rollers rises to a melting point of the parting agent or higher, or the temperature of the sheet before contact with the pair of conveying rollers falls to below the melting point of the parting agent.

According to the present invention, it is possible to prevent the occurrence of gloss unevenness, which is caused by a parting agent contained in a toner, by lowering a temperature of a fixed toner image to below a melting point of a parting agent before contact with a pair of conveying rollers, or by raising a temperature of a toner image to a melting point of a parting agent or higher after contact with a pair of conveying rollers.

Further features of the present invention will become apparent from the following description of exemplary embodiments with reference to the attached drawings.

DESCRIPTION OF THE EMBODIMENTS

Hereinafter, image forming apparatuses according to embodiments of the present invention will be described with reference to FIGS. 1 to 13. An image forming apparatus according to the present embodiment is an image forming apparatus including a fixing portion which melt-fixes a toner image on a sheet by heating a wax-containing toner image as a parting agent, such as a copying machine, a printer, a facsimile machine, and a complex machine thereof. The following embodiments will be described with reference to an electrophotographic color laser beam printer (hereinafter, referred to as a "printer") 1 which thermally fixes four color toner images.

First Embodiment

Figure 1:
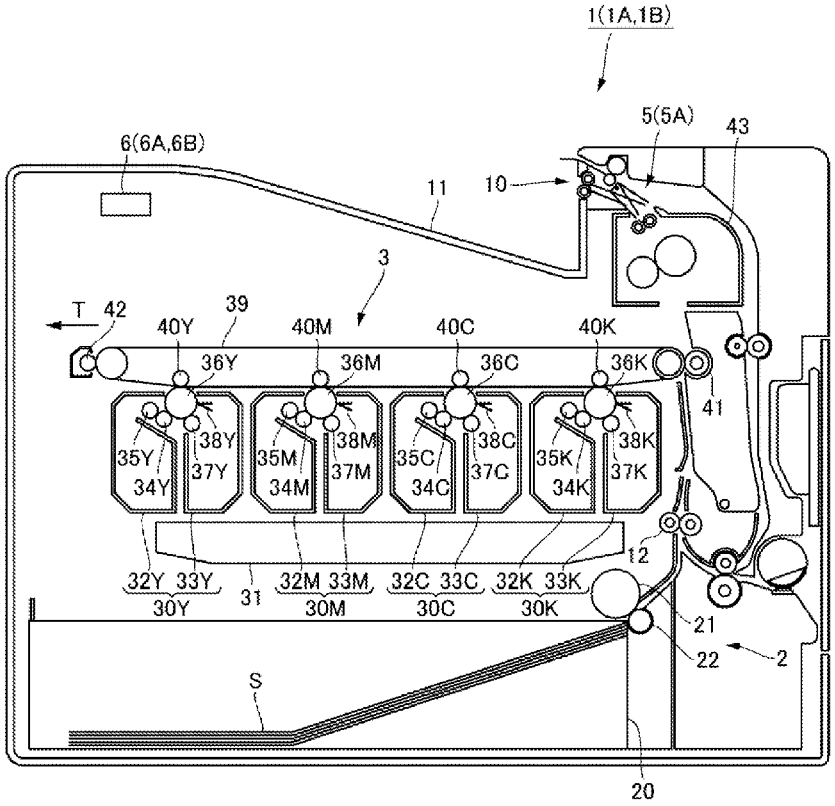
FIG. 1 is a cross-sectional view schematically illustrating an overall structure of a printer according to a first embodiment of the present invention.
Figure 2:
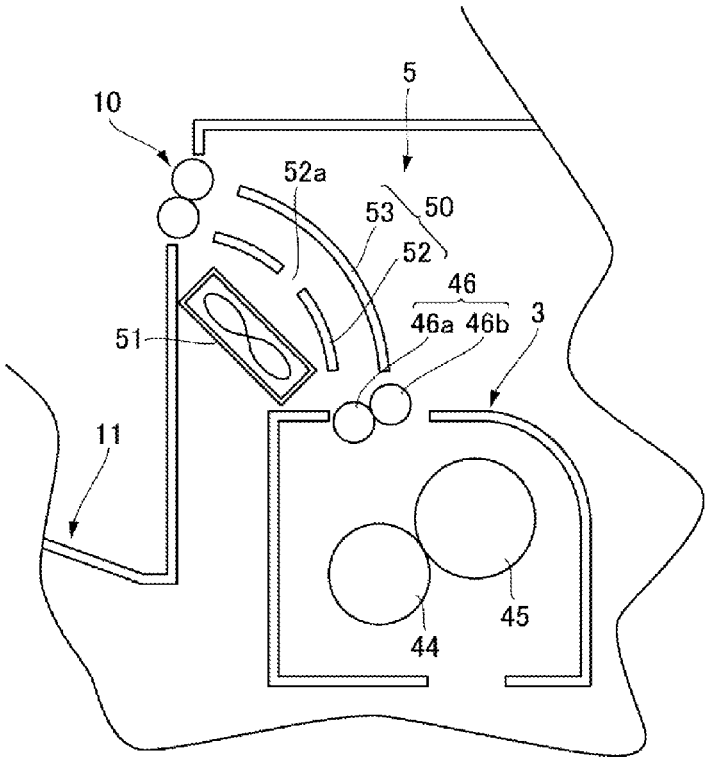
FIG. 2 is a cross-sectional view schematically illustrating a fixing portion and a sheet temperature adjusting portion of the printer according to the first embodiment.
Figure 3A:
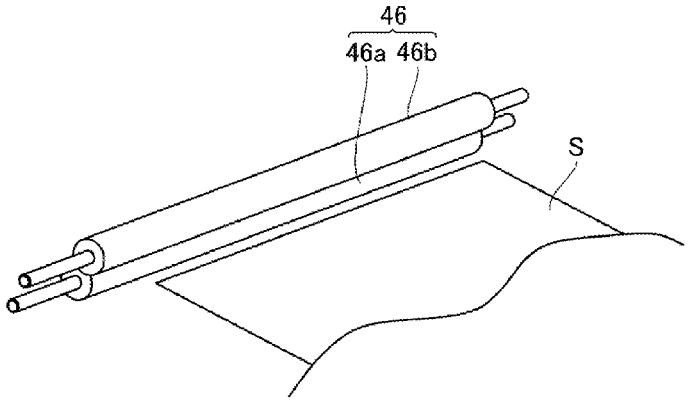
FIGS. 3A and 3B are perspective views illustrating a pair of decurling rollers and a pair of discharge rollers of the printer according to the first embodiment.
Figure 3B:
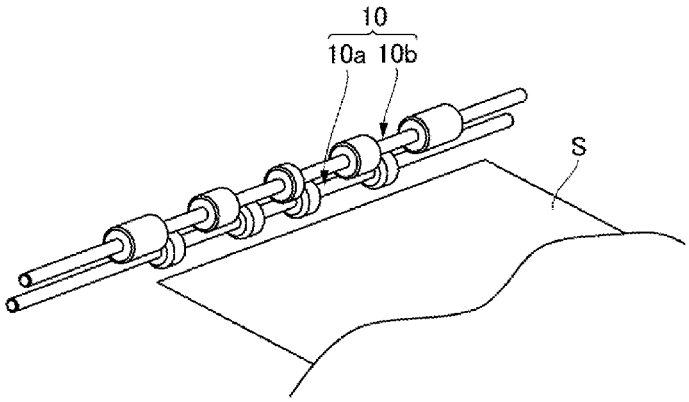

A printer 1 according to a first embodiment of the present invention will be described with reference to FIGS. 1 to 8. First, an overall configuration of the printer 1 according to the first embodiment will be described with reference to FIGS. 1 to 3. FIG. 1 is a cross-sectional view schematically illustrating the overall structure of the printer 1 according to the first embodiment of the present invention. FIG. 2 is a cross-sectional view schematically illustrating a fixing portion 43 and a sheet temperature adjusting portion 5 of the printer 1 according to the first embodiment. FIGS. 3A and 3B are perspective views illustrating a pair of decurling rollers 46 and a pair of discharge rollers 10 of the printer 1 according to the first embodiment.

As illustrated in FIG. 1, the printer 1 includes a sheet feeding portion 2 which feeds a sheet S, an image forming portion 3 which forms an image on the sheet S, and a sheet temperature adjusting portion 5 serving as a sheet temperature adjusting unit which can adjusts a surface temperature of the sheet S on which the image is formed. Also, the printer 1 includes a pair of discharge rollers 10 as a pair of conveying rollers which discharges the sheet S on which the temperature adjustment is performed, a discharge tray 11 which stacks the discharged sheet S, and a controller 6 serving as a controller.

The sheet feeding portion 2 includes a sheet cassette 20 which accommodates the sheet S, a feeding roller 21 which feeds the sheet S accommodated in the sheet cassette 20, a separation pad 22 which separates the sheet S fed by the feeding roller 21 one by one.

The image forming portion 3 includes four process cartridges 30Y, 30M, 30C and 30K which form four color images of yellow (Y), magenta (M), cyan (C), and black (K), and an exposure device 31 which exposures surfaces of photosensitive drums 36Y to 36K to be described below. Also, since the configuration of the four process cartridges 30Y to 30K are the same except that colors of images to be formed are different, the configuration of the process cartridge 30Y which forms a yellow (Y) image will be described, and a description of the process cartridges 30M to 30K will be omitted.

The process cartridge 30Y includes a developing unit 32Y and a cleaner unit 33Y. The developing unit 32Y includes a developing roller 34Y, a toner applying roller 35Y, and a toner container. The cleaner unit 33Y includes a photosensitive drum 36Y being an image bearing member, a charging roller 37Y, a drum cleaning blade 38Y, and a waste toner container.

Also, the image forming portion 3 includes an intermediate an intermediate transfer belt 39 to which toner images on the photosensitive drums 36Y to 36K are primarily transferred, and primary transfer rollers 40Y, 40M, 40C and 40K which primarily transfer the toner images on the photosensitive drums 36Y to 36K to the intermediate transfer belt 39. Also, the image forming portion 3 includes a secondary transfer roller 41 which secondarily transfers the primarily transferred toner images to the sheet S, a cleaning portion 42 which collects a residual toner of the intermediate transfer belt 39, and a fixing portion 43 which thermally heats the secondarily transferred toner images.

As illustrated in FIG. 2, the fixing portion 43 includes a fixing roller 44 as a heating rotating member and a pressure roller 45 as a pressing rotating member serving as a fixing unit which melt-fixes the secondarily transferred toner images by heating and pressurization, and a pair of decurling rollers 46 as a curl correcting rollers which reduces a curvature (curling) of the sheet S on which the toner images are melt-fixed. As illustrated in FIG. 3A, the pair of decurling rollers 46 includes a decurling roller 46*a* and a decurling roller 46*b*. The decurling roller 46*a* and the decurling roller 46*b* are formed such that a width thereof in an axial direction is longer than a width of the sheet S which the printer 1 can feed.

Also, the process cartridges 30Y to 30K, the exposure device 31, the intermediate transfer belt 39, the primary transfer rollers 40Y to 40K, and the secondary transfer roller 41 constitute a toner image forming unit.

The sheet temperature adjusting portion 5 includes a conveying guide 50 which guides the sheet S, on which the image is thermally fixed by the fixing portion 43, toward the pair of discharge rollers 10, and a blower fan 51 serving as a sheet temperature adjusting unit which blows air to the sheet S moving along the conveying guide 50. The conveying guide 50 includes a first guide 52 provided in a fixing roller 44 side in a sheet conveying direction and a second guide 53 provided in a pressure roller 45 side, and an air blowing hole 52*a* is provided in the first guide 52. The blower fan 51 is disposed to face the first guide 52 and blows air to the surface of the sheet S which moves from the air blowing hole 52*a* to the conveying guide 50.

As illustrated in FIG. 3B, the pair of discharge rollers 10 includes a first roller 10*a* and a second roller 10*b*, and the first roller 10*a* and the second roller 10*b* have a plurality of roller bodies firmly fixed to a rotational shaft at predetermined intervals. Also, the first roller 10*a* and the second roller 10*b* are formed to have a so-called tooth shape in which a plurality of roller bodies is disposed to be offset in an axial direction. This is because when the large-sized sheet S is discharged, it is necessary to impart stiffness to the sheet S.

Figure 4:
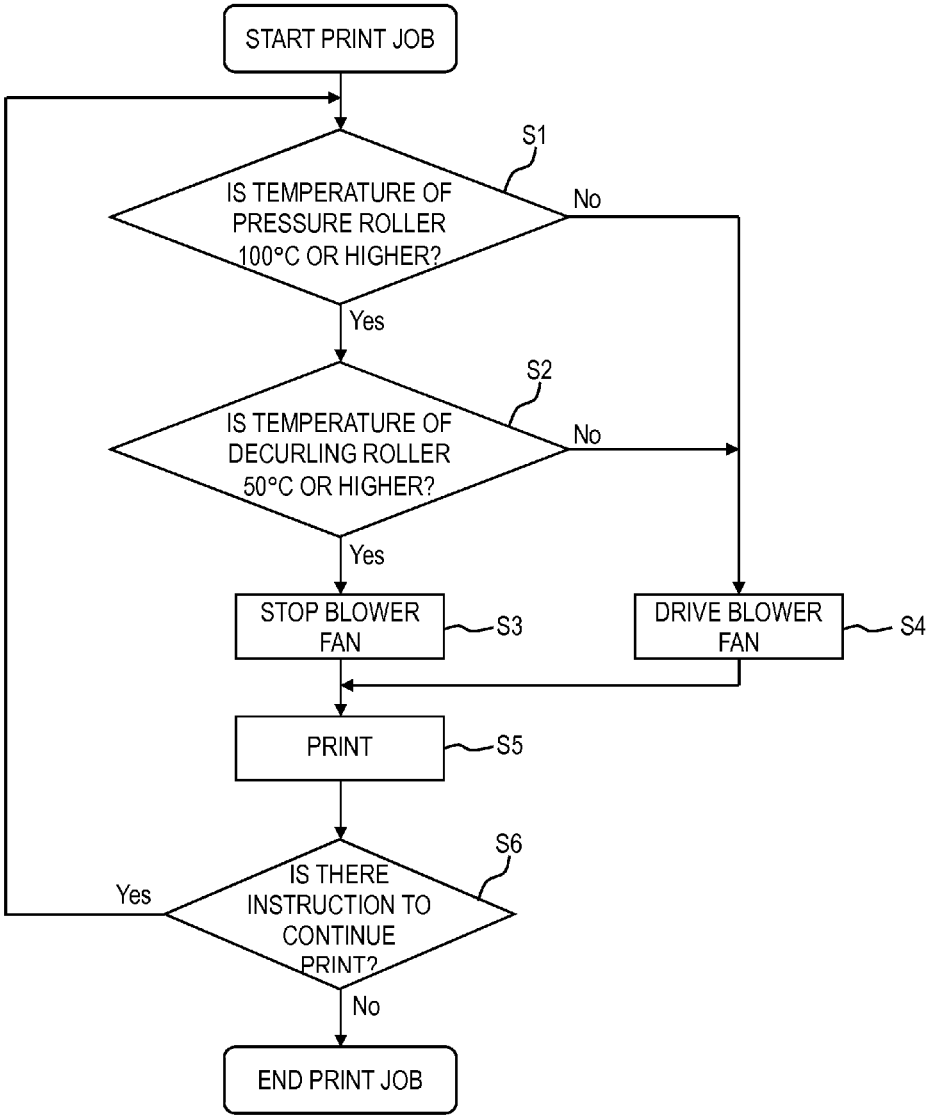
FIG. 4 is a flowchart of a print job which is performed by a controller of the printer according to the first embodiment.

Next, a print job (image forming job) which is performed by the controller 6 of the printer 1 configured as above will be described with reference to FIG. 4. FIG. 4 is a flowchart of the print job which is performed by the controller 6 of the printer 1 according to the first embodiment.

As illustrated in FIG. 4, when a print job is started according to setting of an operation portion, the controller 6, first, controls a driving of the blower fan 51 based on predicted temperatures of the pressure roller 45 and the decurling roller 46*a*. In the present embodiment, the controller 6 stops driving the blower fan 51 when the temperature of the pressure roller 45 is 100° C. or higher and the temperature of the decurling roller 46*a* is 50° C. or higher (steps S1 to S3). That is, the cooling of the sheet by the blower fan 51 is not performed. On the other hand, when the temperature of the pressure roller 45 is 100° C. or lower or when the temperature of the decurling roller 46*a* is 50° C. or lower, the controller 6 drives the blower fan 51 to rotate (step S4). Therefore, the surface temperature of the sheet S when being in contact with the pair of discharge rollers 10 is prevented from being around a melting point (first temperature) of the wax. Also, the driving control of the blower fan 51, which is performed by the controller 6 based on the temperatures of the pressure roller 45 and the decurling roller 46*a* so as to prevent the surface temperature of the sheet S from being around the melting point of the wax, will be described below in detail. Also, the predicted temperatures of the pressure roller 45 and the decurling roller 46*a* will be described below in detail.

Next, when image information is input from an image reading apparatus (not illustrated) or an external PC (not illustrated), the exposure device 31 irradiates a laser beam toward the photosensitive drums 36Y to 36K, based on the input image information. At this time, the photosensitive drums 36Y to 36K are charged to a negative potential in advance by the charging rollers 37Y to 37K. When the laser beam is irradiated, an electrostatic latent image is formed on the photosensitive drums 36Y to 36K. The electrostatic latent image is reversely developed by the developing rollers 34Y to 34K and the toner applying rollers 35Y to 35K, and a negative toner is attached thereto. Toner images of yellow (Y), magenta (M), cyan (C), and black (K) are formed on the photosensitive drums 36Y to 36K.

The respective color toner images which are formed on the photosensitive drums 36Y to 36K are primarily transferred to the intermediate transfer belt 39 in a superimposed state, sequentially from the photosensitive drums 36Y to 36K, by applying a positive bias to the primary transfer rollers 40Y to 40K. The four color toner images, which are primarily transferred to the intermediate transfer belt 39 are conveyed to the secondary transfer roller 41 in the superimposed state by the rotation driving of the intermediate transfer belt 39.

In parallel to the above-described operation of forming the toner image, the sheet S accommodated in the sheet cassette 20 is fed toward the pair of registration rollers 12 one by one by the feeding roller 21 and the separation pad 22. The printer 1 corrects a skew feeding of the sheet S and matches a conveying timing of the image and the sheet to the secondary transfer roller 41 by the pair of registration rollers 12. By applying a positive bias to the secondary transfer roller 41, the four toner images on the intermediate transfer belt 39 are secondarily transferred to the sheet S conveyed to the secondary transfer roller 41 at a predetermined conveying timing.

Also, the toner remaining on the surfaces of the photosensitive drums 36Y to 36K after the transfer of the toner image is removed by the drum cleaning blades 38Y, 38M, 38C and 38K. Also, the toner remaining on the intermediate transfer belt 39 after the secondary transfer to the sheet S is removed by the cleaning portion 42 and is collected in a waste toner collection container (not illustrated).

The sheet S, to which the toner image is transferred, is conveyed to the fixing portion 43 and is heated and pressurized by the fixing roller 44 and the pressure roller 45, and the toner image is fixed on the surface of the sheet S. When the toner image is fixed on the surface of the sheet S, the pair of decurling rollers 46 conveys the sheet S to the pair of discharge rollers 10 along the conveying guide 50 while reducing a curl of the sheet S after the fixation. When moving along the conveying guide 50, the sheet S is cooled by the blower fan 51 when the blower fan 51 is driven, and the sheet S passes without being cooled by the blower fan 51 when the driving of the blower fan 51 is stopped. Therefore, the surface temperature of the sheet S when being in contact with the first roller 10*a* and the second roller 10*b* is prevented from being around the melting point of the wax.

The sheet S, which is conveyed to the pair of discharge rollers 10, is discharged to the discharge tray 11 by the pair of discharge rollers 10 and is stacked on the discharge tray 11 (step S5). When there is an instruction to continue the print, those described above are repeated, and when there is no instruction to continue the print, the print job is ended (step S6).

Next, the driving control of the blower fan 51, which is performed by the controller 6 so as to prevent the surface temperature of the sheet S from being around the melting point of the wax when the sheet S contacts with the pair of discharge rollers 10, will be described with reference to FIGS. 5 to 8.

In the present embodiment, a wax-containing toner is used as a parting agent. Therefore, if the sheet S is nipped and conveyed to the pair of discharge rollers 10 when the temperature of the toner image on the sheet S after the fixation is around the melting point of the wax contained in the toner, a difference in the cooling state of the wax occurs in a contact portion and a non-contact portion between the sheet S and the pair of discharge rollers 10. As a result, gloss unevenness (hereinafter, referred to as "roller mark") occurs in the image formed on the sheet. The roller mark becomes unevenness in the width of the plurality of roller bodies in the pair of discharge rollers 10 including the first roller 10*a* and the second roller 10*b* disposed in a comb-teeth shape.

The occurrence of the roller mark can be prevented by cooling the fixed sheet S to the melting point of the wax or lower before the sheet S contacts with the pair of discharge rollers 10. Also, even when the temperature of the sheet S is lowered after the sheet S contacts with the pair of discharge rollers 10, the occurrence of the roller mark causing an image defect can be prevented unless the contact portion between the pair of discharge rollers 10 and the sheet S falls to below the melting point of the wax. Therefore, in the first embodiment, by controlling the driving (rotation and stop) of the blower fan 51 by the controller 6, the surface temperature of the sheet S is controlled such that the surface temperature of the sheet S when being in contact with the pair of discharge rollers 10 is prevented from being around the melting point of the wax. In this manner, the roller mark is prevented.

Figure 5:
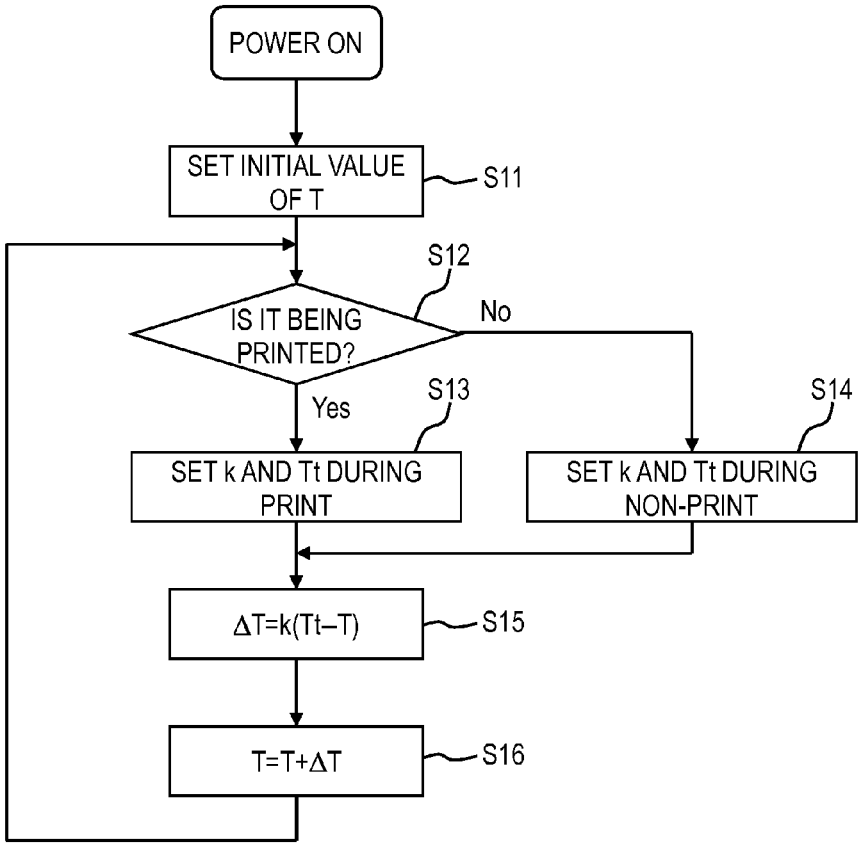
FIG. 5 is a flowchart of a temperature prediction of a pressing rotating member and a decurling roller according to the first embodiment.

A determination as to whether to rotate or stop the blower fan 51 is performed based on the predicted temperatures of the pressure roller 45 and the decurling roller 46*a* which have a great influence on the surface temperature of the sheet S. First, the predicted temperatures of the pressure roller 45 and the decurling roller 46*a* will be described below with reference to FIG. 5. FIG. 5 is a flowchart of a temperature prediction of the pressure roller 45 and the decurling roller 46*a* according to the first embodiment.

As illustrated in FIG. 5, when power is ON, an initial predicted temperature T is set from a predicted temperature T when power is OFF at previous time, an ambient temperature of the printer 1, and a temperature of the fixing roller 44 (step S11). Subsequently, it is determined whether it is being printed (step S12). When it is being printed, a target temperature (Tt) and a temperature change coefficient (k) are set according to a type or a feeding mode of the sheet S and a presence or absence of the sheet S in the nip (step S13). On the other hand, when it is not being printed, the target temperature (Tt) and the temperature change coefficient (k) during non-print are set (step S14). When the target temperature (Tt) and the temperature change coefficient (k) are set, a temperature variation ΔT is calculated using the set target temperature (Tt) and the set temperature change coefficient (k), as expressed in Math. (1) below (step S15).

$$\Delta T = k(Tt - T) \quad \text{Math. (1)}$$

Using the calculated temperature variation ΔT, the latest predicted temperature T is calculated as expressed in Math. (2) below (step S16).

$$T=T+\Delta T \quad \text{Math. (2)}$$

Also, the prediction of the temperature always continues calculation while the power is ON, the predicted temperature T is calculated at intervals of 0.1 second by using a predetermined target temperature (Tt) and a predetermined temperature change coefficient (k) set according to a type of the sheet S or a sheet passing mode. Also, parameters of the target temperature (Tt) and the temperature change coefficient (k) are different in the pressure roller 45 and the decurling roller 46*a*, but the methods of calculating the predicted temperature T are the same and are calculated according to the above-described flowchart.

Figure 6:
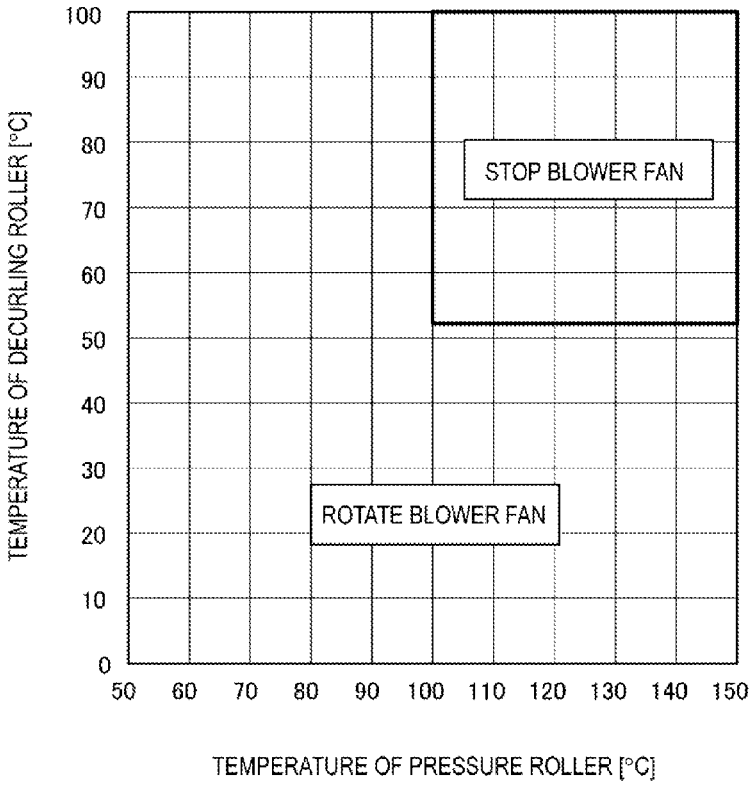
FIG. 6 is a diagram illustrating a temperature condition of a temperature control of a blower fan according to the first embodiment.
Figure 7:
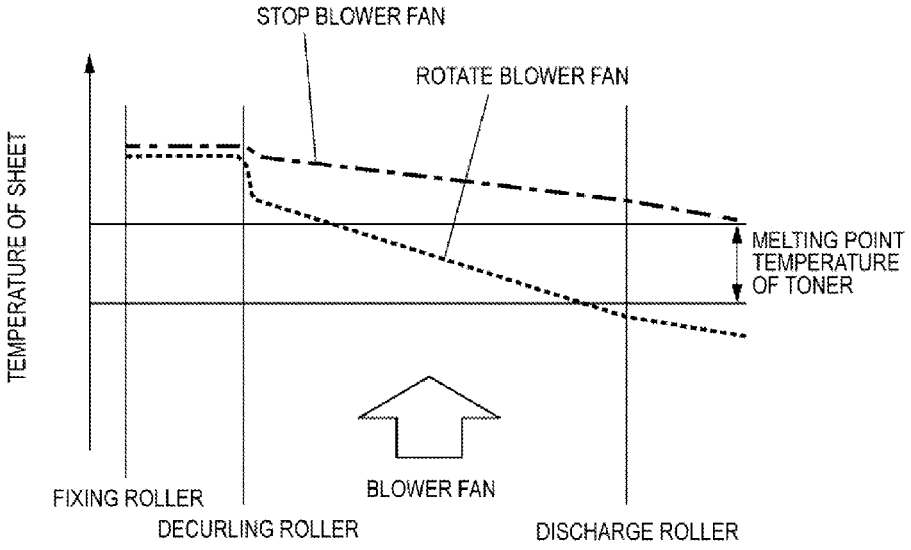
FIG. 7 is a diagram illustrating a temperature change of a sheet in a case where a rotation control for roller mark prevention is performed on the blower fan according to the first embodiment.

Next, the temperature change of the sheet S when the driving control is performed on the blower fan 51 so as to prevent the occurrence of the roller mark will be described with reference to FIGS. 6 and 7. FIG. 6 is a diagram illustrating a temperature condition of the temperature control of the blower fan 51 according to the first embodiment. FIG. 7 is a diagram illustrating the temperature change of the sheet S in a case where a driving control for roller mark prevention is performed on the blower fan 51 according to the first embodiment.

The melting point of the wax according to the present embodiment is about 70° C. to 75° C. Therefore, as illustrated in FIG. 6, a condition that the wax becomes the melting point or higher even after the sheet S contacts with the pair of discharge rollers 10 is satisfied when the temperature of the pressure roller 45 is 100° C. as a second temperature or higher and the temperature of the decurling roller 46*a* is 50° C. as a third temperature or higher. Therefore, in this case, the blower fan 51 is stopped, and under the other temperature conditions, the blower fan 51 is rotated.

First, the temperature change of the sheet S in the case of rotating the blower fan 51 will be described below. Rotating the blower fan 51 is performed when the temperature of the sheet S discharged from the decurling roller 46*a* is low. Specifically, as illustrated in FIG. 7, this is the case where the temperature of the sheet S before contact with the pair of discharge rollers 10 falls to the melting point of the wax or lower by rotating the blower fan 51. Also, the "case where temperature of the sheet S is low" refers to a state in which when the blower fan 51 is rotated, the surface temperature of the sheet S becomes lower than the melting point of the wax before the sheet S contacts with the pair of discharge rollers 10, but when stopped, the surface temperature of the sheet S is around the melting point of the wax when the sheet S contacts with the pair of discharge rollers 10.

This is a case where the perimeter of the fixing portion 43 is cold. Since the decurling roller 46*a* is cold, the sheet S discharged from the fixing roller 44 is greatly cooled by the decurling roller 46*a*. In this case, by rotating the blower fan 51 and further cooling the sheet S, the surface temperature of the sheet S can be cooled to the melting point of the wax or lower before the sheet S contacts with the pair of discharge rollers 10. Therefore, the occurrence of the roller mark can be prevented.

Next, the temperature change of the sheet S in the case of stopping the blower fan 51 will be described below. Stopping the blower fan 51 is performed when the temperature of the sheet S discharged from the decurling roller 46*a* is high. Specifically, as illustrated in FIG. 7, this is the case where the sheet S is not cooled by the blower fan 51, and even after the sheet S contacts with the pair of discharge rollers 10, the temperature of the contact portion between the sheet S and the pair of discharge rollers 10 is the melting point of the wax or higher. Also, the case where "temperature of the sheet is high" refers to a state in which when the blower fan 51 is rotated, the surface temperature of the sheet S is around the melting point of the wax when the sheet S contacts with the pair of discharge rollers 10, and when stopped, the surface temperature of the sheet S is the melting point of the wax or higher after the sheet S contacts with the pair of discharge rollers 10.

This is a case where the perimeter of the fixing portion 43 is warm. Since the decurling roller 46*a* is warm, a decrease in the temperature of the sheet S discharged from the pair of decurling rollers 46 is small. Since the sheet S is not cooled by the blower fan 51, the sheet S can contact with the pair of discharge rollers 10 in a state in which the temperature of the sheet S remains high, and the temperature of the sheet S is not below the melting point of the wax even after the sheet S contacts with the pair of discharge rollers 10.

However, since the temperature of the sheet S is higher than that of the pair of discharge rollers 10, the temperature of the sheet S is lowered when the sheet S contacts with the pair of discharge rollers 10, and a difference in temperature occurs in the contact region and the non-contact region. However, the temperature of the sheet S in the contact region is sufficiently higher than the melting point of the wax. In the contact region and the non-contact region, there is a slight difference in the cooling state of the wax, but the roller mark causing the image defect does not occur.

Figure 8A:
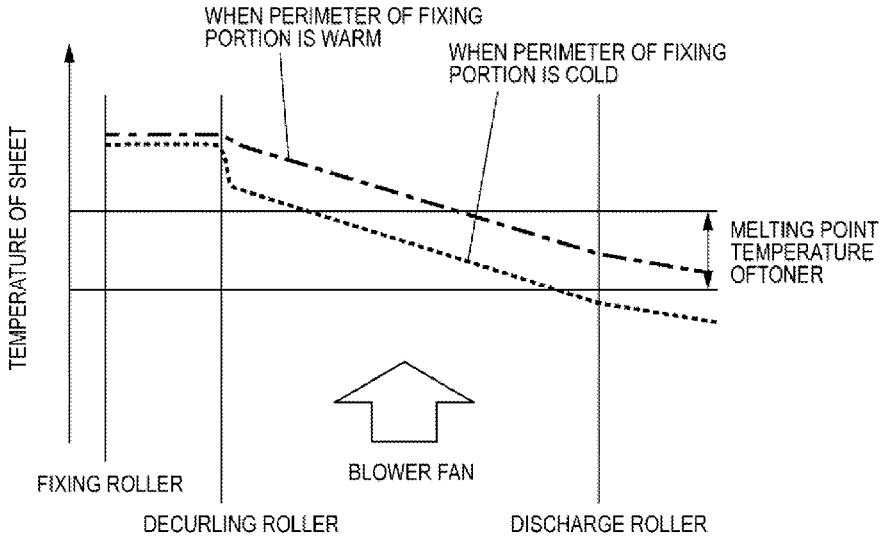
FIGS. 8A and 8B are diagrams illustrating a temperature change of a sheet in a case where a rotation control for roller mark prevention is not performed on the blower fan according to the first embodiment.
Figure 8B:
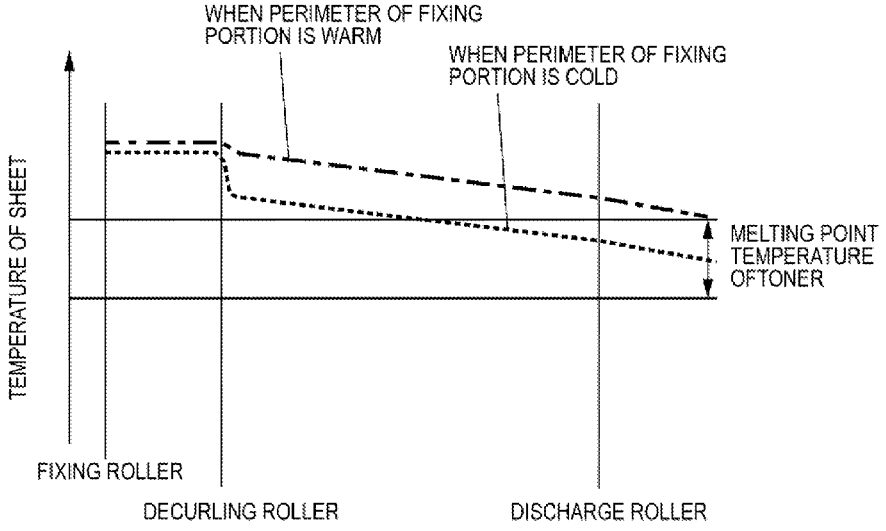

Next, the case where the driving control of the blower fan 51 for preventing the occurrence of the roller mark is not performed will be described with reference to FIGS. 8A and 8B. FIGS. 8A and 8B are diagrams illustrating the temperature change of the sheet S in a case where the rotation control for roller mark prevention is performed on the blower fan 51 according to the first embodiment. Also, FIG. 8A illustrates the case where the blower fan 51 is rotated regardless of the warm state of the perimeter of the fixing portion 43, and FIG. 8B illustrates the case where the blower fan 51 is stopped.

As illustrated in FIG. 8A, in the case where the blower fan 51 is continuously rotate, in the case where the perimeter of the fixing portion 43 is cold, the occurrence of the roller mark can be prevented as described above. On the other hand, in the case where the perimeter of the fixing portion 43 is warm, if the sheet S is cooled by the blower fan 51, the sheet S has a temperature around the melting point of the wax when the sheet S contacts with the pair of discharge rollers 10. Therefore, when the sheet S contacts with the pair of discharge rollers 10 in a state in which the temperature of the sheet S is around the melting point of the wax, the roller mark is formed in the sheet S.

Also, as illustrated in FIG. 8B, in the case where the blower fan 51 is stopped, in the case where the perimeter of the fixing portion 43 is cold, the sheet S is cooled by the decurling roller 46*a*. However, since the blower fan 51 is stopped, the sheet S discharged from the decurling roller 46*a* is not cooled. Therefore, the sheet S has a temperature around the melting point of the wax when the sheet S contacts with the pair of discharge rollers 10. Therefore, when the sheet S contacts with the pair of discharge rollers 10 in a state in which the temperature of the sheet S remains around the melting point of the wax, the roller mark is formed in the sheet S. On the other hand, in the case where the perimeter of the fixing portion 43 is warm, the occurrence of the roller mark can be prevented as described above.

As described above, the printer 1 according to the first embodiment includes the blower fan 51 between the fixing portion 43 and the pair of discharge rollers 10 and is configured to be able to control the blower fan 51. Therefore, when the sheet S contacts with the pair of discharge rollers 10, it is possible to prevent the surface temperature of the sheet S from being around the melting point of the wax. Therefore, when the image is formed on the sheet S by using the wax-containing toner, the occurrence of the roller mark (gloss unevenness) can be prevented.

Also, since the printer 1 according to the first embodiment prevents the occurrence of the roller mark by the driving control of the blower fan 51, it is unnecessary to provide a large-sized cooling device or to perform cooling by reducing a sheet conveying speed. That is, the occurrence of the roller mark can be prevented by a simple configuration. Also, the printer 1 according to the first embodiment stops the blower fan 51 when the perimeter of the fixing portion 43 is warm, and contacts with the sheet S with the pair of discharge rollers 10 in a state in which the temperature of the sheet S remains high. Therefore, it is possible to prevent the reduction of productivity caused by the increased cooling time of the sheet S.

Second Embodiment

Next, a printer 1A according to a second embodiment of the present invention will be described with reference to FIGS. 9 to 11 as well as FIG. 1. The printer 1A according to the second embodiment is different from the first embodiment in the sheet temperature adjusting unit. Therefore, the second embodiment will be described focusing on the difference from the first embodiment, that is, the sheet temperature adjusting unit. In the second embodiment, the same reference numerals as those used in the first embodiment are assigned to the same configurations as those of the first embodiment, and a description thereof will be omitted.

First, an overall configuration of the printer 1A according to the second embodiment will be described with reference to FIGS. 1 and 9. FIG. 9 is a cross-sectional view schematically illustrating a fixing portion 43 and a sheet temperature adjusting portion 5A of the printer 1A according to the second embodiment.

As illustrated in FIG. 1, the printer 1A includes a sheet feeding portion 2, an image forming portion 3, a sheet temperature adjusting portion 5A serving as a sheet temperature adjusting unit, a conveying guide 50A, a pair of discharge rollers 10, a discharge tray 11, and a controller 6A.

Figure 9:
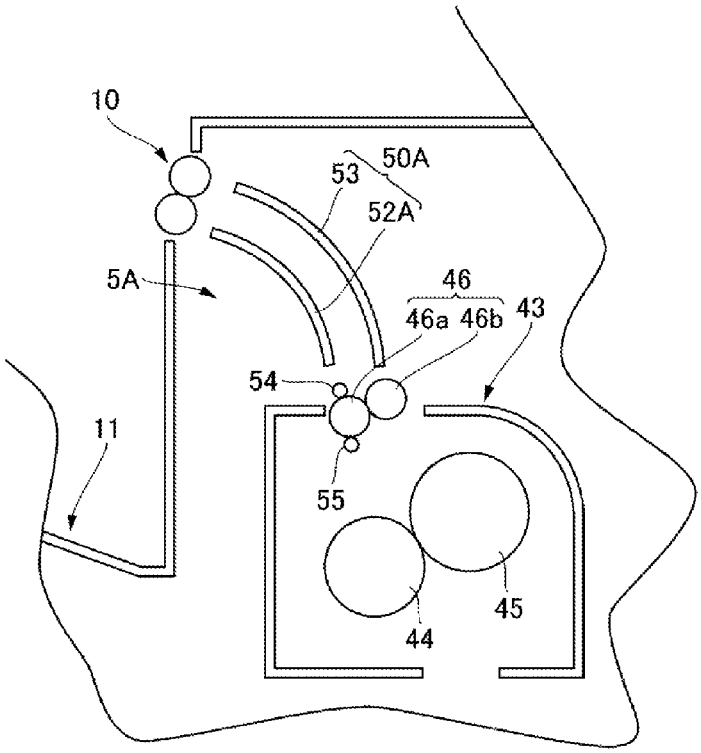
FIG. 9 is a cross-sectional view schematically illustrating a fixing portion and a sheet temperature adjusting portion of a printer according to a second embodiment.

As illustrated in FIG. 9, the sheet temperature adjusting portion 5A includes a heating member 54 which heats a decurling roller 46*a*, and a cooling member 55 which cools the decurling roller 46*a*. The heating member 54 is a roller with a built-in heater and abuts against an outer circumferential surface of the decurling roller 46*a*. The heating member 54 heats the roller by applying an electric current to the heater so that the decurling roller 46*a* is heated by the roller. The cooling member 55 is formed to have a pipe shape by a heat transfer material and abuts against the outer circumferential surface of the decurling roller 46*a*. The cooling member 55 cools the pipe by circulating air inside so that the decurling roller 46*a* is cooled by the pipe.

The conveying guide 50A includes a first guide 52A provided in a fixing roller 44 side in a sheet conveying direction, and a second guide 53 provided in a pressure roller 45 side. The conveying guide 50A guides the sheet S, on which the image is thermally fixed, toward the pair of discharge rollers 10.

Next, a print job (image forming job) by the controller 6A of the printer 1A configured as above will be described with reference to FIG. 10. FIG. 10 is a flowchart of the print job which is performed by the controller 6A of the printer 1A according to the second embodiment.

Figure 10:
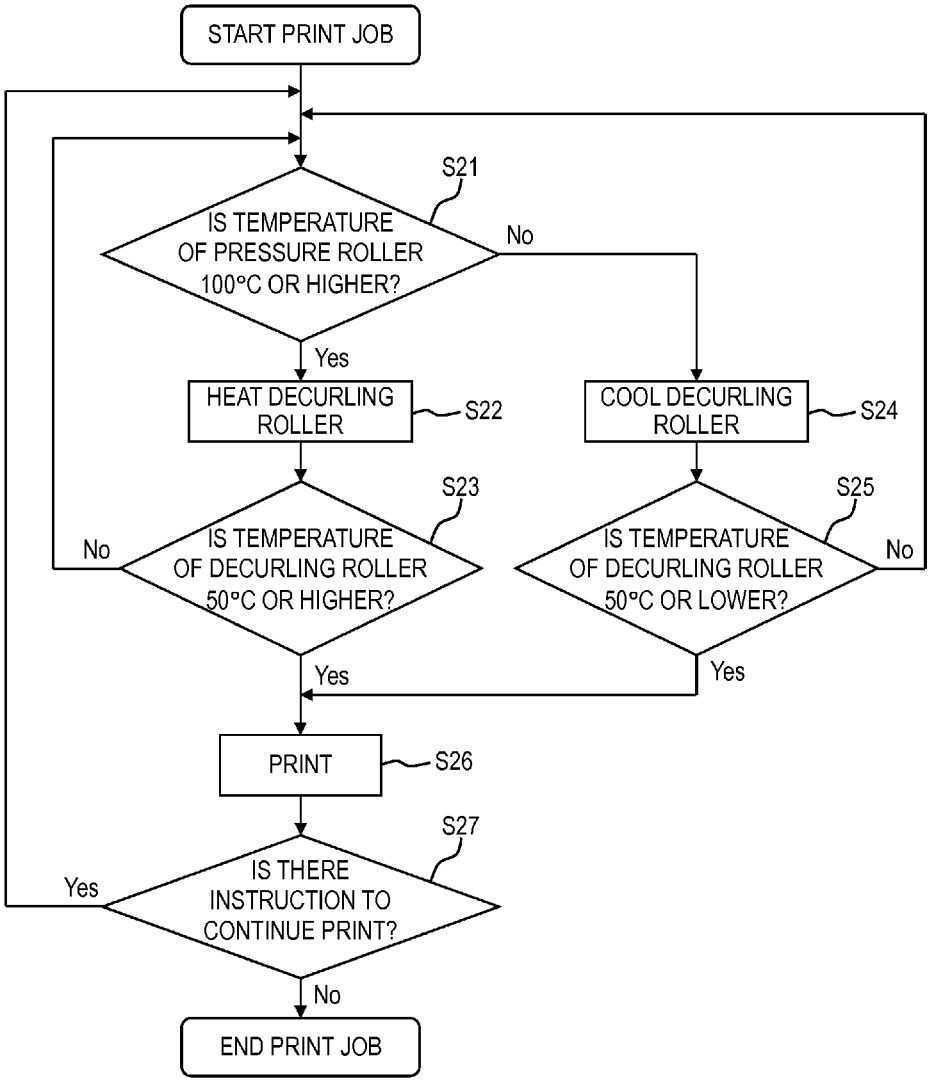
FIG. 10 is a flowchart of a print job which is performed by a controller of the printer according to the second embodiment.
Figure 11:
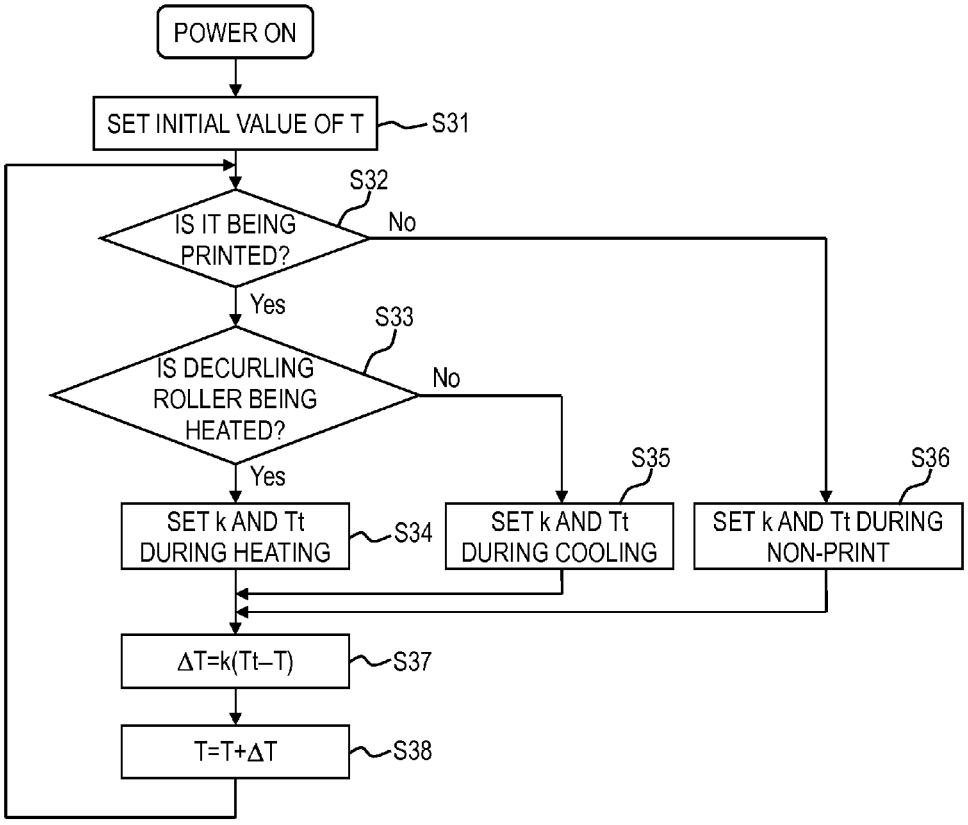
FIG. 11 is a flowchart of a temperature prediction of a pressing rotating member and decurling rollers according to the second embodiment.

As illustrated in FIG. 10, when a print job is started according to setting of an operation portion or the like, the controller 6A heats the decurling roller 46*a* by the heating member 54 when the temperature of the pressure roller 45 is 100° C. or higher (steps S21 and S22). The heating of the decurling roller 46*a* is performed until the temperature of the decurling roller 46*a* becomes 50° C. or higher (step S23). When the temperature of the decurling roller 46*a* becomes 50° C. or higher, image forming on the sheet S is performed. Also, since the image forming on the sheet S (step S26) is substantially identical to that of the first embodiment, a detailed description thereof will be omitted herein.

On the other hand, when the temperature of the pressure roller 45 is 100° C. or lower, the controller 6A cools the decurling roller 46*a* by the cooling member 55 (step S24). The cooling of the decurling roller 46*a* is performed until the temperature of the decurling roller 46*a* becomes 50° C. or lower (step S25). When the temperature of the decurling roller 46*a* becomes 50° C. or lower, image forming on the sheet S is performed, and, as described above, a description thereof will be omitted. When there is an instruction to continue the print, those described above are repeated, and when there is no instruction to continue the print, the print job is ended (step S27).

Next, the temperature control of the heating member 54 and the cooling member 55, which is performed by the controller 6A so as to prevent the surface temperature of the sheet S from being around the melting point of the wax when the sheet S contacts with the pair of discharge rollers 10, will be described with reference to FIG. 11. FIG. 11 is a flowchart of a temperature prediction of the pressure roller 45 and the decurling roller 46*a* according to the second embodiment.

The temperature control of the heating member 54 and the cooling member 55 is performed based on the predicted temperatures of the pressure roller 45 and the decurling roller 46*a* which have a great influence on the surface temperature of the sheet S. As illustrated in FIG. 11, when power is ON, an initial predicted temperature T is set from a predicted temperature T when power is OFF at previous time, an ambient temperature of the printer 1A, and a temperature of the fixing roller 44 (step S31). Subsequently, it is determined whether it is being printed (step S32). When it is being printed, it is determined whether the decurling roller 46*a* is being heated (step S33). When the decurling roller 46*a* is being heated, a target temperature (Tt) and a temperature change coefficient (k) during the heating are set (step S34). On the other hand, when it is being cooled (not being heated), the target temperature (Tt) and the temperature change coefficient (k) during the cooling are set (step S35). Also, when it is not being printed (No in step S32), the target temperature (Tt) and the temperature change coefficient (k) during non-print are set (step S36).

When the target temperature (Tt) and the temperature change coefficient (k) are set, a temperature variation ΔT is calculated using the set target temperature (Tt) and the set temperature change coefficient (k), as expressed in Math. (1) above (step S37). Using the calculated temperature variation ΔT, the latest predicted temperature T is calculated as expressed in Math. (2) above (step S38).

Also, the prediction of the temperature always continues calculation while the power is ON, the predicted temperature T is calculated at intervals of 0.1 second by using a predetermined target temperature (Tt) and a predetermined temperature change coefficient (k) set according to a type of the sheet S or a sheet passing mode. Also, parameters of the target temperature (Tt) and the temperature change coefficient (k)

are different in the pressure roller 45 and the decurling roller 46*a*, but the methods of calculating the predicted temperature T are the same and are calculated according to the above-described flowchart.

As described above, the printer 1A according to the second embodiment can control the temperature of the decurling roller 46*a* which directly influences the temperature of the sheet S, such that the temperature of the sheet S rises to the melting point of the toner or higher after contact with the pair of discharge rollers 10, or the temperature of the sheet S falls to below the melting point of the toner before contact with the pair of discharge rollers 10. Therefore, the occurrence of the roller mark can be prevented.

Also, since the decurling roller 46*a* is heated and cooled by the heating member 54 and the cooling member 55 brought into contact with the outer circumferential surface of the decurling roller 46*a*, the temperature of the decurling roller 46*a* can be finely controlled. Therefore, the temperature control of the sheet S can be performed with higher accuracy than the printer 1 of the first embodiment. Therefore, the occurrence of the roller mark can be efficiently prevented.

Third Embodiment

Next, a printer 1B according to a third embodiment of the present invention will be described with reference to FIGS. 12 and 13 as well as FIG. 1. The printer 1B according to the third embodiment is different from the first embodiment in that a temperature of a sheet S is adjusted by a fixing portion 43. Therefore, the third embodiment will be described focusing on the difference from the first embodiment, that is, the temperature control of the sheet S which is performed by the fixing portion 43. In the third embodiment, the same reference numerals as those used in the first embodiment are assigned to the same configurations as those of the first embodiment, and a description thereof will be omitted.

First, an overall configuration of the printer 1B according to the third embodiment will be described with reference to FIG. 1. As illustrated in FIG. 1, the printer 1B includes a sheet feeding portion 2, an image forming portion 3, a pair of discharge rollers 10, a discharge tray 11, and a controller 6B. The image forming portion 3 includes process cartridges 30Y to 30K, an exposure device 31, an intermediate transfer belt 39, primary transfer rollers 40Y to 40K, a secondary transfer roller 41, a cleaning portion 42, and a fixing portion 43. The fixing portion 43 includes a fixing roller 44, a pressure roller 45, and a pair of decurling rollers 46.

Next, a print job (image forming job) by the controller 6B of the printer 1B configured as above will be described with reference to FIG. 12. FIG. 12 is a flowchart of the print job which is performed by the controller 6B of the printer 1B according to the third embodiment.

Figure 12:
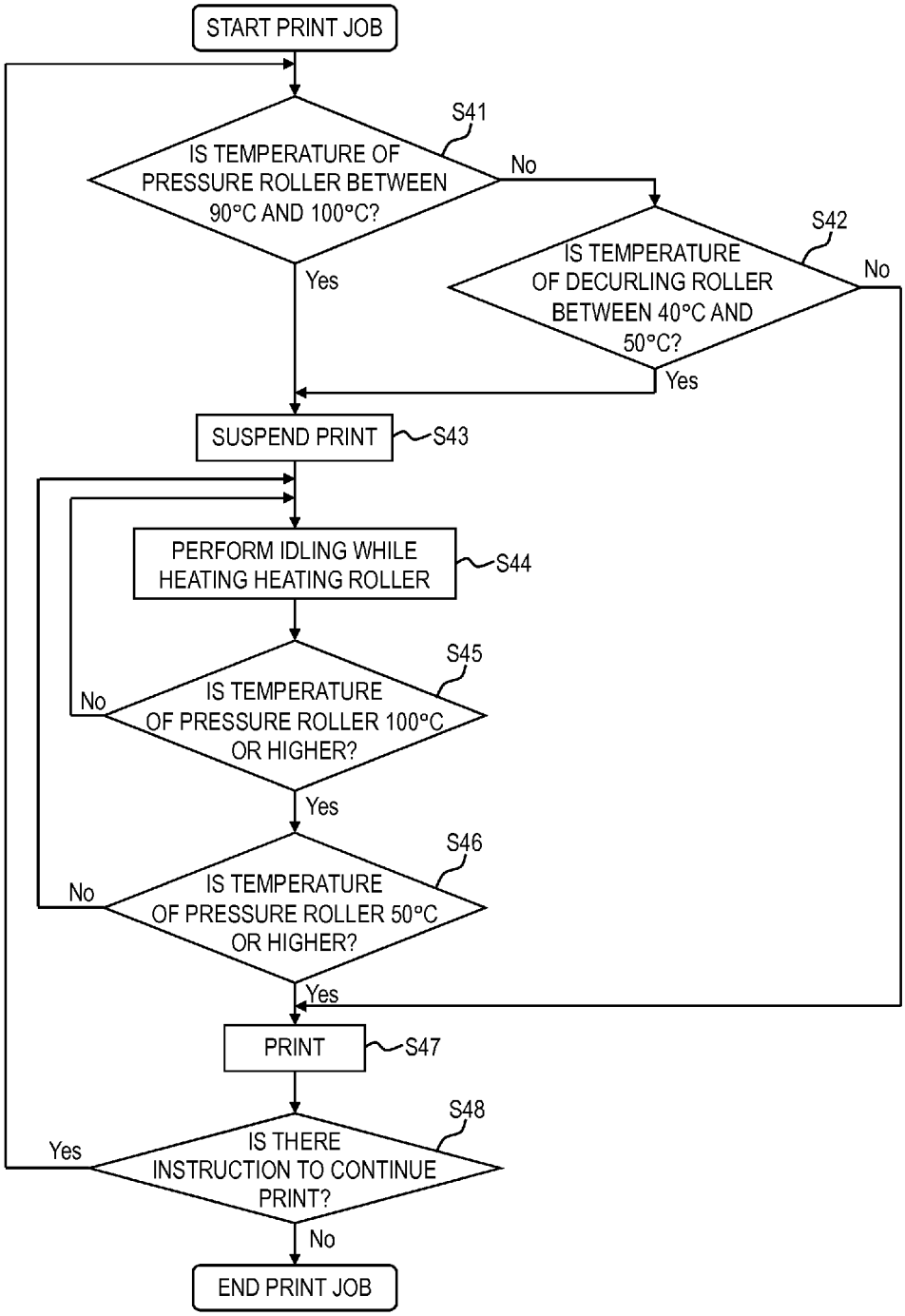
FIG. 12 is a flowchart of a print job which is performed by a controller of a printer according to a third embodiment.
Figure 13:
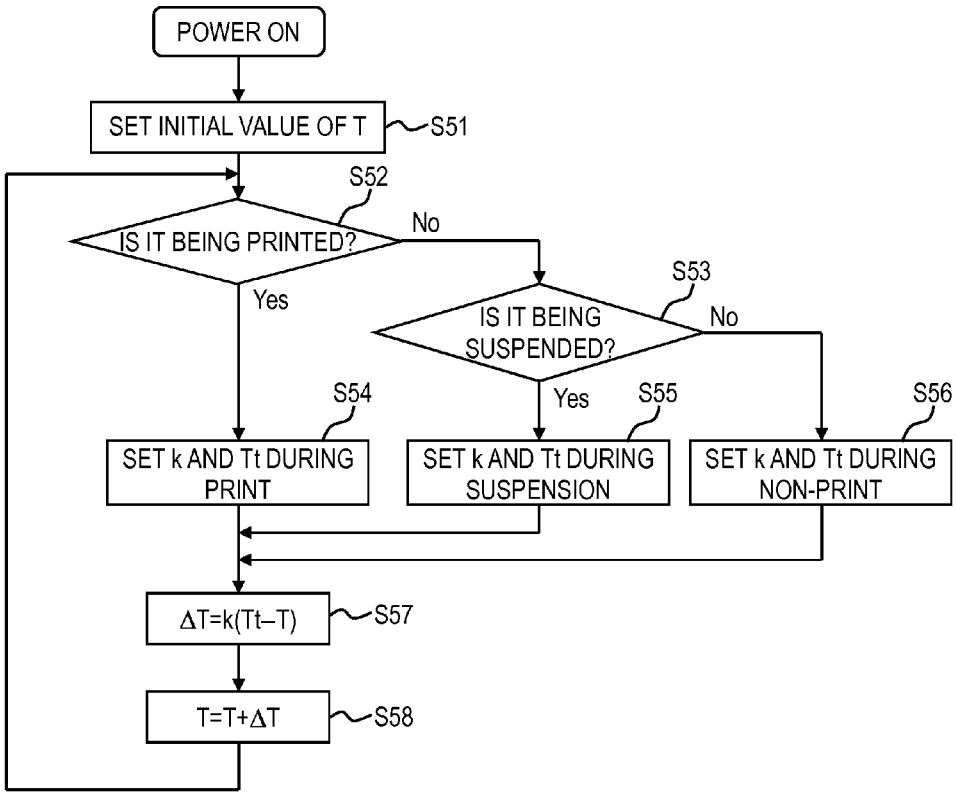
FIG. 13 is a flowchart of a temperature prediction of a pressing rotating member and decurling rollers according to the third embodiment.

As illustrated in FIG. 12, when a print job is started according to setting of an operation portion or the like, the controller 6B primarily stops the print when the temperature of the pressure roller 45 is between 90° C. and 100° C. (step S41). Also, even though the temperature of the pressure roller 45 is 90° C. or lower, or 100° C. or higher, the controller 6B primarily stops the print when temperature of the decurling roller 46*a* is between 40° C. and 50° C. (step S42). When the output is suspended (step S43), the controller 6B idles the fixing roller 44 while heating the fixing roller 44 at a temperature during print until the temperature of the pressure roller 45 is 100° C. or higher or the temperature of the decurling roller 46*a* is 50° C. or higher (steps S44 to S46). In this manner, the temperature of the pressure roller 45 abutting against the fixing roller 44 is raised and the ambient temperature of the fixing roller 44 is raised, resulting in a rise in the temperature of the decurling roller 46*a* disposed above the fixing roller 44.

When the temperature of the pressure roller 45 is 100° C. or higher and the temperature of the decurling roller 46*a* is 50° C. or higher, the controller 6B resumes the print (step S47). Also, since the print (step S47) is substantially identical to the first embodiment, a description thereof will be omitted herein. On the other hand, in step S42, the print is resumed even when the temperature of the decurling roller 46*a* is 40° C. or lower or 50° C. or higher (No in step S42), and as described above, a description thereof will be omitted. When there is an instruction to continue the print, those described above are repeated, and when there is no instruction to continue the print, the print job is ended (step S48).

Next, the temperature control of the decurling roller 46*a* by the suspension of the print, which is performed by the controller 6A so as to prevent the surface temperature of the sheet S from being around the melting point of the wax when the sheet S contacts with the pair of discharge rollers 10, will be described with reference to FIG. 13. FIG. 13 is a flowchart of a temperature prediction of the pressure roller 45 and the decurling roller 46*a* according to the third embodiment.

The above-described temperature control of the decurling roller 46*a* by the suspension of the print is performed based on the predicted temperatures of the pressure roller 45 and the decurling roller 46*a*. As illustrated in FIG. 13, when power is ON, an initial predicted temperature T is set from a predicted temperature T when power is OFF at previous time, an ambient temperature of the printer 1A, and a temperature of the fixing roller 44 (step S51). Subsequently, it is determined whether it is being printed (step S52). When it is being printed, a target temperature (Tt) and a temperature change coefficient (k) during the print are set (step S54).

On the other hand, when it is not being printed, it is determined whether it is being suspended (step S53). When it is being suspended, a target temperature (Tt) and a temperature change coefficient (k) during the suspension are set (step S55). On the other hand, when it is not being suspended, the target temperature (Tt) and the temperature change coefficient (k) during non-print are set (step S56).

When the target temperature (Tt) and the temperature change coefficient (k) are set, a temperature variation $\Delta T$ is calculated using the set target temperature (Tt) and the set temperature change coefficient (k), as expressed in Math. (1) above (step S57). Using the calculated temperature variation $\Delta T$, the latest predicted temperature T is calculated as expressed in Math. (2) above (step S58).

Also, the prediction of the temperature continues calculation as long as the power is ON, the predicted temperature T is calculated at intervals of 0.1 second by using a predetermined target temperature (Tt) and a predetermined temperature change coefficient (k) set according to a type of the sheet S or a sheet passing mode. Also, parameters of the target temperature (Tt) and the temperature change coefficient (k) are different in the pressure roller 45 and the decurling roller 46*a*, but the methods of calculating the predicted temperature T are the same and are calculated according to the above-described flowchart.

As described above, the printer 1B according to the third embodiment performs the suspension of the print according to the temperatures of the pressure roller 45 and the decurling roller 46*a*. Therefore, before the suspension of the print, the temperature of the sheet S can be the melting point of the wax or lower before contact with the pair of discharge rollers 10, and, after the suspension, the temperature of the sheet S can be the melting point of the wax or higher even after contact with the pair of discharge rollers 10. Also, the printer 1B according to the third embodiment can prevent the occurrence of the roller mark by an inexpensive configuration because it is unnecessary to add a new member for performing heating or cooling.

The embodiments of the present invention have been described above, but the present invention is not limited to the above-described embodiments. Also, the effects expected in the embodiments of the present invention are merely enumeration of the most suitable effects occurring in the present invention, and the effects of the present invention are not limited to those described in the embodiments of the present invention.

For example, the first embodiment has been described with reference to the printer 1 in which the pair of decurling rollers 46 is provided downstream of the fixing roller 44 and the pressure roller 45 in the sheet conveying direction and the pair of discharge rollers 10 is provided downstream of the pair of decurling rollers 46 in the sheet conveying direction, but the present invention is not limited thereto. The present invention has only to include a configuration in which the pair of discharge rollers 10 is provided downstream of the fixing roller 44 and the pressure roller 45 in the sheet conveying direction, and the sheet temperature adjusting unit such as the blower fan 51 is provided between the fixing roller 44 and the pair of discharge rollers 10 and between the pressure roller 45 and the pair of discharge rollers 10.

Also, in the first embodiment, in order to predict the surface temperature of the sheet S when the sheet S contacts with the first roller 10*a* and the second roller 10*b*, the temperatures of the pressure roller 45 and the pair of decurling rollers 46 are predicted, but the present invention is not limited thereto. The present invention has only to be able to predict the surface temperature of the sheet S when the sheet S contacts with the first roller 10*a* and the second roller 10*b*, and may directly predict the surface temperature of the sheet S.

Also, in the first embodiment, the surface temperature of the sheet S when the sheet S contacts with the first roller 10*a* and the second roller 10*b* is predicted by predicting the temperatures of the pressure roller 45 and the pair of decurling rollers 46, but the present invention is not limited thereto. In the present invention, the surface temperature of the sheet S when the sheet S contacts with the first roller 10*a* and the second roller 10*b* may be predicted by measuring the temperatures of the pressure roller 45 and the pair of decurling rollers 46. Also, the present invention may be configured to actually measure the surface temperature of the sheet S when the sheet S contacts with the first roller 10*a* and the second roller 10*b*.

Also, in the first embodiment, the temperature of the sheet S is controlled by the rotation and stop of the blower fan 51, but the present invention is not limited thereto. The present invention may be configured to control the temperature of the sheet S by controlling the rotational speed of the blower fan 51.

Also, in the second embodiment, the decurling roller 46*a* is heated and cooled using the heating member 54 and the cooling member 55 contacting with the outer circumferential surface of the decurling roller 46*a*, but the present invention is not limited thereto. When the conveying roller is provided between the pair of discharge roller 10 and the fixing portion 43, the conveying roller may be configured to be heated and cooled.

Also, in the third embodiment, the temperature control of the decurling roller 46*a* is performed by the suspension of the print, but the present invention is not limited thereto. When the conveying roller is provided between the pair of discharge roller 10 and the fixing portion 43, the conveying roller may be configured to be heated and cooled.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-273754, filed Dec. 14, 2012, which is hereby incorporated by reference herein in its entirety.

What is claimed is:

1. An image forming apparatus comprising:

a toner image forming unit which forms a toner image on a sheet by using a toner containing a parting agent;

a fixing unit which fixes the toner image formed on the sheet;

a conveying unit provided downstream of the fixing unit in a sheet conveyance direction and which conveys the sheet on which the toner image is fixed, while contacting the sheet;

a cooling unit which is capable of cooling down the temperature of the sheet on which the toner image is fixed, before a downstream edge of the sheet in the conveyance direction on which the toner image is fixed arrives at the conveying unit; and a controller which determines whether or not the cooling unit cools down the sheet, wherein the controller determines to control the cooling unit to cool the sheet in a case that the temperature of the sheet which is cooled by the cooling unit is lower than a first temperature before the downstream edge of the sheet in the conveyance direction contacts the conveying unit, and the controller determines to control the cooling unit to refrain from cooling the sheet in a case that the temperature of the sheet does not become lower than the first temperature even after the downstream edge of the sheet contacts the conveying unit.

2. The image forming apparatus according to claim 1, wherein the first temperature is approximately the melting point of the parting agent.

3. The image forming apparatus according to claim 1, wherein the first temperature is in a range between 70° C. and 75° C.

4. The image forming apparatus according to claim 1, wherein the controller predicts the temperature of the sheet after the sheet contacts with the conveying unit or before the sheet contacts the conveying unit, and determines whether or not the cooling unit cools down the sheet based on the predicted temperature.

5. The image forming apparatus according to claim 1, further comprising an other conveying unit which is provided downstream of the fixing unit and upstream of the conveying unit in the conveyance direction and which conveys the sheet, the other conveying unit being configured to contact the entire width of the sheet in a direction perpendicular to the sheet conveying direction, and wherein the controller predicts the temperature of the other conveying unit, and determines whether or not the cooling unit cools down the sheet fan based on the predicted temperature.

6. The image forming apparatus according to claim 1, wherein the fixing unit includes a heating rotating member and a pressing rotating member, wherein in a case where the temperature of the pressing rotating member exceeds a second temperature predetermined, the controller determines not to cool down the sheet by the cooling unit.

7. The image forming apparatus according to claim 1, further comprising an other conveying unit which is provided downstream of the fixing unit and upstream of the conveying unit in the conveyance direction and which conveys the sheet, the other conveying unit being configured to contact the entire width of the sheet in a direction perpendicular to the sheet conveying direction, wherein in a case where the temperature of the other conveying unit exceeds a second predetermined temperature, the controller determines not to cool down the sheet by the cooling unit.

8. The image forming apparatus according to claim 1, wherein the conveying unit is configured not to contact the entire width of the sheet in a direction perpendicular to the sheet conveying direction.

9. The image forming apparatus according to claim 1, wherein the cooling unit is a fan configured to blow wind.

10. The image forming apparatus according to claim 9, wherein the controller drives the fan in a case that a cooling operation for the sheet is to be performed, and the controller stops the fan in a case that cooling operation for the sheet is not to be performed.

11. The image forming apparatus according to claim 1, wherein the temperature of the sheet is the temperature of a surface thereof.

12. An image forming apparatus comprising:

a toner image forming unit which forms a toner image on a sheet by using a toner containing a parting agent;

a fixing unit which thermally fixes the toner image formed on the sheet;

a pair of conveying rollers which conveys the sheet, a temperature of which is adjusted;

a cooling unit configured to cool the sheet on which the toner image is fixed by reducing the temperature of the sheet, before a downstream edge of the sheet in the conveyance direction on which the toner image is fixed arrives at the pair of conveying rollers; and a controller which determines whether or not the cooling unit cools down the sheet, wherein the controller determines to control the cooling unit to cool the sheet in a case that the temperature of the sheet which is cooled by the cooling unit is lower than a first temperature before the downstream edge of the sheet in the conveyance direction contacts the pair of conveying rollers, wherein the controller determines to control the cooling unit to refrain from cooling the sheet in a case that the temperature of the sheet does not become lower than the first temperature even after the downstream edge of the sheet contacts the pair of conveying rollers.

13. An image forming apparatus comprising:

a toner image forming unit which forms a toner image on a sheet by using a toner containing a parting agent;

a fixing unit which fixes the toner image formed on the sheet;

a conveying unit provided downstream of the fixing unit in a sheet conveyance direction and which conveys the sheet on which the toner image is fixed, while contacting the sheet;

an other conveying unit which is provided downstream of the fixing unit and upstream of the conveying unit in the conveyance direction and which conveys the sheet, the other conveying unit being configured to contact the entire width of the sheet in a direction perpendicular to the sheet conveying direction;

a cooling unit which is capable of cooling down a temperature of the sheet on which the toner image is fixed, before a downstream edge of the sheet in the conveyance direction on which the toner image is fixed arrives at the conveying unit; and a controller which determines whether or not the cooling unit cools down the sheet, wherein the controller determines to control the cooling unit to cool the sheet in a case that the temperature of the other conveying unit is lower than a first predetermined temperature, and the controller determines to control the cooling unit not to cool the sheet in a case that the temperature of the other conveying unit is not lower than the first predetermined temperature.

14. The image forming apparatus according to claim 13, wherein the conveying unit is configured not to contact the entire width of the sheet in a direction perpendicular to the sheet conveying direction.

15. The image forming apparatus according to claim 13, wherein the cooling unit is a fan configured to blow wind.

16. The image forming apparatus according to claim 15, wherein the controller drives the fan in a case that the cooling operation for the sheet is to be performed, and the controller stops the fan in the case cooling operation for the sheet is not to be performed.

17. The image forming apparatus according to claim 13, wherein the fixing unit includes a heating rotating member and a pressing rotating member, wherein in a case where the temperature of the pressing rotating member does not exceed a second temperature predetermined, the controller determines to control the cooling unit to cool down the sheet.

18. The image forming apparatus according to claim 17, wherein the second temperature predetermined is higher than the first predetermined temperature.

19. The image forming apparatus according to claim 13, wherein the fixing unit includes a heating rotating member and a pressing rotating member, in a case where the temperature of the pressing rotating member does not exceed a second temperature predetermined, the controller determines to control the cooling unit to cool down the sheet.

20. The image forming apparatus according to claim 13, wherein the temperature of the sheet is the temperature of surface thereof.

21. An image forming apparatus comprising:

a toner image forming unit which forms a toner image on a sheet by using a toner containing a parting agent;

a fixing unit which fixes the toner image formed on the sheet;

a conveying unit provided downstream of the fixing unit in a sheet conveyance direction and which conveys the sheet on which the toner image is fixed, while contacting the sheet;

a cooling unit which is capable of cooling down the temperature of the sheet on which the toner image is fixed, before a downstream edge of the sheet in the conveyance direction on which the toner image is fixed arrives at the conveying unit; and a controller which determines whether or not the cooling unit cools down the sheet, wherein the controller determines to control the cooling unit to cool the sheet in the case that the temperature of the sheet, which is cooled by the cooling unit, is lower than a predetermined temperature after a downstream edge in a conveying direction of the sheet passes the fixing unit and before the downstream edge of the sheet contacts the conveying unit, and the controller determines to control the cooling unit not to cool the sheet in the case that the temperature of the sheet is not lower than the predetermined temperature after the downstream edge passes the fixing unit and before the downstream edge of the sheet contacts the conveying unit.

22. An image forming apparatus comprising:

a toner image forming unit which forms a toner image on a sheet by using a toner containing a parting agent;

a fixing unit which fixes the toner image formed on the sheet;

a conveying unit provided downstream of the fixing unit in a sheet conveyance direction and which conveys the sheet on which the toner image is fixed, while contacting the sheet;

a cooling unit which is capable of cooling down the temperature of the sheet on which the toner image is fixed, before a downstream edge of the sheet in the conveyance direction on which the toner image is fixed arrives at the conveying unit; and a controller which controls the power of the cooling unit to cool the sheet, wherein the controller determines to control the cooling unit to cool the sheet with a first cooling power in the case that the temperature of the sheet is lower than a predetermined temperature after a downstream edge in a conveying direction of the sheet passes the fixing unit and before the downstream edge of the sheet contacts the conveying unit, and the controller determines to control the cooling unit to cool the sheet with a second cooling power, which is weaker than the first cooling power, in the case that the temperature of the sheet is not lower than the predetermined temperature after the downstream edge passes the fixing unit and before the downstream edge of the sheet contacts the conveying unit.

23. The image forming apparatus according to claim 22, wherein the second cooling power is zero.

* * * * *